US005944062A

United States Patent [19]

Gampe

[11] Patent Number: 5,944,062

[45] Date of Patent: Aug. 31, 1999

[54] PAPERMAKING FABRIC WITH MUTUALLY CONTACTING PAIRED WEFT THREADS

[75] Inventor: Harald Gampe, Wöllersdorf, Austria

[73] Assignee: Cristini Forming Fabrics GmbH, Vienna, Austria

[21] Appl. No.: 08/891,584

[22] Filed: Jul. 11, 1997

[51] Int. Cl.[6] ..... D21F 1/00; D03D 11/00; D03D 13/00

[52] U.S. Cl. ..... 139/383 A

[58] Field of Search ..... 139/383 A

[56] References Cited

U.S. PATENT DOCUMENTS

| | | | |
|---|---|---|---|
| 4,149,571 | 4/1979 | Burroughs | 139/383 A |
| 4,636,426 | 1/1987 | Fleischer | 139/383 A |
| 4,934,414 | 6/1990 | Borel | 139/383 A |
| 4,967,805 | 11/1990 | Chiu et al. . | |
| 5,092,372 | 3/1992 | Fitzka et al. | 139/383 A |
| 5,473,981 | 12/1995 | Mazaki | 139/383 A |
| 5,713,398 | 2/1998 | Josef | 139/383 A |
| 5,826,627 | 10/1998 | Seabrook et al. | 139/383 A |

FOREIGN PATENT DOCUMENTS

| | | |
|---|---|---|
| 0 044 053 | 1/1982 | European Pat. Off. . |
| 0 117 856 | 9/1984 | European Pat. Off. . |
| 0 325 167 | 1/1989 | European Pat. Off. . |
| 0 408 849 | 1/1991 | European Pat. Off. . |
| 0 677 612 | 10/1995 | European Pat. Off. . |
| 33 29 739 | 1/1985 | Germany . |

*Primary Examiner*—Andy Falik
*Attorney, Agent, or Firm*—Herbert Dubno

[57] ABSTRACT

A paper-making fabric having two or three weft layers. The two layer fabric has in its upper layer paired weft threads lying against one another and interwoven with a warp binding in mutually parallel relationship. The three layer fabric also has the paired weft threads with the warp interweaving with all of the three weft layers.

The papermaking fabric to Seabrook et al U.S. Pat. No. (5,826,627) is of general interest for its disclosure to paired weft threads in its upper layer. However, unlike the structure disclosed in the instant claims 4&5 said reference weft threads aren't disclosed to be in mutual parallel relationship lying against each other.

2 Claims, 3 Drawing Sheets

Fig.1 PRIOR ART
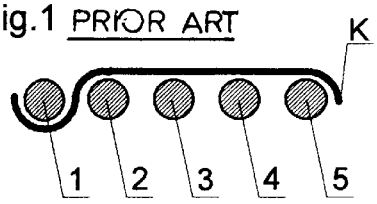
Fig.2
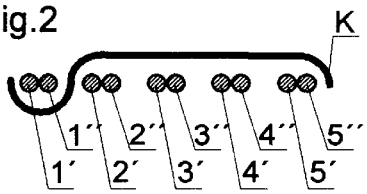
Fig.3 PRIOR ART
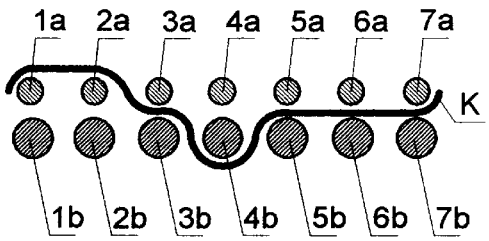
Fig.4
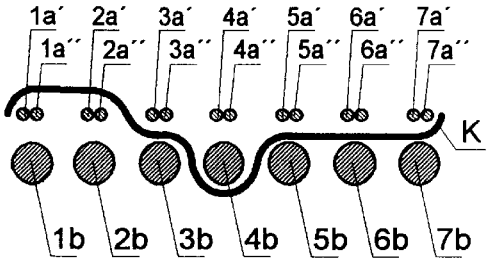
Fig.5
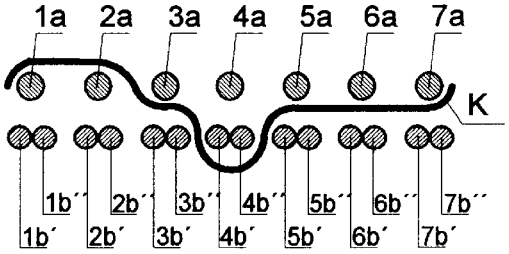
Fig.6A PRIOR ART
| | K 1 | K 2 | K 3 | K 4 | K 5 | K 6 | K 7 | K 8 | K 9 | K 10 | K 11 | K 12 | K 13 | K 14 |
|---|---|---|---|---|---|---|---|---|---|---|---|---|---|---|
| 1 a | X | | | X | | | | X | | | X | | | |
| 2 a | X | | | | | X | | X | | | | | X | |
| 3 a | | | X | | | X | | | | X | | | X | |
| 4 a | X | | X | | | | | X | | X | | | | |
| 5 a | X | | | | X | | | X | | | | X | | |
| 6 a | | | X | | X | | | | | X | | X | | |
| 7 a | | | X | | | | X | | | X | | | | X |
| 8 a | | | | | X | | X | | | | | X | | X |
| 9 a | | X | | | X | | | | X | | | X | | |
| 10 a | | X | | | | | X | | X | | | | | X |
| 11 a | | | | X | | | X | | | | X | | | X |
| 12 a | | X | | X | | | | | X | | X | | | |
| 13 a | | X | | | | X | | | X | | | | X | |
| 14 a | | | | X | | X | | | | | X | | X | |
Fig.6 PRIOR ART
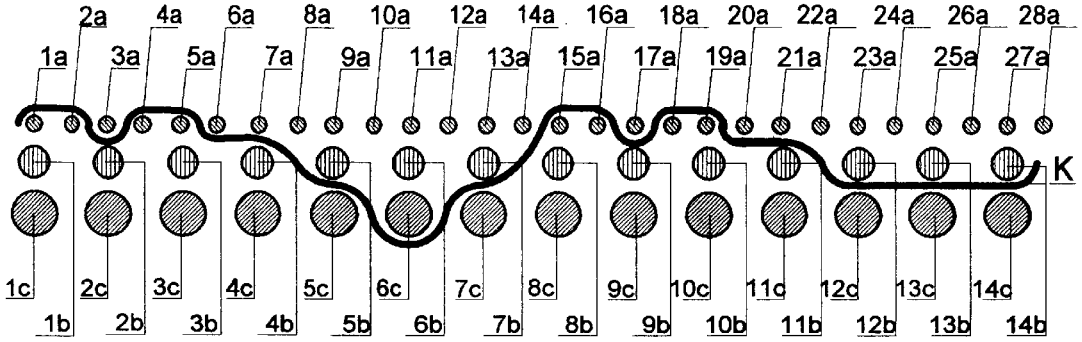

Fig. 7A

| | K 1 | K 2 | K 3 | K 4 | K 5 | K 6 | K 7 | K 8 | K 9 | K 10 | K 11 | K 12 | K 13 | K 14 |
|---|---|---|---|---|---|---|---|---|---|---|---|---|---|---|
| 1 a′ | X | | | X | | | | X | | | X | | | |
| 1 a′′ | X | | | X | | | | X | | | X | | | |
| 2 a′ | X | | | | | X | | X | | | | | X | |
| 2 a′′ | X | | | | | X | | X | | | | | X | |
| 3 a′ | | | X | | | X | | | | X | | | X | |
| 3 a′′ | | | X | | | X | | | | X | | | X | |
| 4 a′ | X | | X | | | | | X | | X | | | | |
| 4 a′′ | X | | X | | | | | X | | X | | | | |
| 5 a′ | X | | | | X | | | X | | | | X | | |
| 5 a′′ | X | | | | X | | | X | | | | X | | |
| 6 a′ | | | X | | X | | | | | X | | X | | |
| 6 a′′ | | | X | | X | | | | | X | | X | | |
| 7 a′ | | | X | | | | X | | | X | | | | X |
| 7 a′′ | | | X | | | | X | | | X | | | | X |
| 8 a′ | | | | | X | | X | | | | | X | | X |
| 8 a′′ | | | | | X | | X | | | | | X | | X |
| 9 a′ | | X | | | X | | | | X | | | X | | |
| 9 a′′ | | X | | | X | | | | X | | | X | | |
| 10 a′ | | X | | | | | X | | X | | | | | X |
| 10 a′′ | | X | | | | | X | | X | | | | | X |
| 11 a′ | | | | X | | | X | | | | X | | | X |
| 11 a′′ | | | | X | | | X | | | | X | | | X |
| 12 a′ | | X | | X | | | | | X | | X | | | |
| 12 a′′ | | X | | X | | | | | X | | X | | | |
| 13 a′ | | X | | | | X | | | X | | | | X | |
| 13 a′′ | | X | | | | X | | | X | | | | X | |
| 14 a′ | | | | X | | X | | | | | X | | X | |
| 14 a′′ | | | | X | | X | | | | | X | | X | |

Fig. 8A

| | K 1 | K 2 | K 3 | K 4 | K 5 | K 6 | K 7 | K 8 | K 9 | K 10 | K 11 | K 12 | K 13 | K 14 |
|---|---|---|---|---|---|---|---|---|---|---|---|---|---|---|
| 1 b′ | X | | X | X | | X | | X | | X | X | | X | |
| 1 b′′ | X | | X | X | | X | | X | | X | X | | X | |
| 2 b′ | X | | X | | X | X | | X | | X | | X | X | |
| 2 b′′ | X | | X | | X | X | | X | | X | | X | X | |
| 3 b′ | X | | X | | X | | X | X | | X | | X | | X |
| 3 b′′ | X | | X | | X | | X | X | | X | | X | | X |
| 4 b′ | | X | X | | X | | X | | X | X | | X | | X |
| 4 b′′ | | X | X | | X | | X | | X | X | | X | | X |
| 5 b′ | | X | | X | X | | X | | X | | X | X | | X |
| 5 b′′ | | X | | X | X | | X | | X | | X | X | | X |
| 6 b′ | | X | | X | | X | X | | X | | X | | X | X |
| 6 b′′ | | X | | X | | X | X | | X | | X | | X | X |
| 7 b′ | X | X | | X | | X | | X | X | | X | | X | |
| 7 b′′ | X | X | | X | | X | | X | X | | X | | X | |
| 8 b′ | X | | X | X | | X | | X | | X | X | | X | |
| 8 b′′ | X | | X | X | | X | | X | | X | X | | X | |
| 9 b′ | X | | X | | X | X | | X | | X | | X | X | |
| 9 b′′ | X | | X | | X | X | | X | | X | | X | X | |
| 10 b′ | X | | X | | X | | X | X | | X | | X | | X |
| 10 b′′ | X | | X | | X | | X | X | | X | | X | | X |
| 11 b′ | | X | X | | X | | X | | X | X | | X | | X |
| 11 b′′ | | X | X | | X | | X | | X | X | | X | | X |
| 12 b′ | | X | | X | X | | X | | X | | X | X | | X |
| 12 b′′ | | X | | X | X | | X | | X | | X | X | | X |
| 13 b′ | | X | | X | | X | X | | X | | X | | X | X |
| 13 b′′ | | X | | X | | X | X | | X | | X | | X | X |
| 14 b′ | X | X | | X | | X | | X | X | | X | | X | |
| 14 b′′ | X | X | | X | | X | | X | X | | X | | X | |

Fig.9A

| | K 1 | K 2 | K 3 | K 4 | K 5 | K 6 | K 7 | K 8 | K 9 | K 10 | K 11 | K 12 | K 13 | K 14 |
|---|---|---|---|---|---|---|---|---|---|---|---|---|---|---|
| 1 c′ | X | X | X | X | X | X | | X | X | X | X | X | X | X |
| 1 c′′ | X | X | X | X | X | X | | X | X | X | X | X | X | X |
| 2 c′ | X | | X | X | X | X | X | X | X | X | X | X | X | X |
| 2 c′′ | X | | X | X | X | X | X | X | X | X | X | X | X | X |
| 3 c′ | X | X | X | X | X | X | X | X | X | X | | X | X | X |
| 3 c′′ | X | X | X | X | X | X | X | X | X | X | | X | X | X |
| 4 c′ | X | X | X | X | X | | X | X | X | X | X | X | X | X |
| 4 c′′ | X | X | X | X | X | | X | X | X | X | X | X | X | X |
| 5 c′ | | X | X | X | X | X | X | X | X | X | X | X | X | X |
| 5 c′′ | | X | X | X | X | X | X | X | X | X | X | X | X | X |
| 6 c′ | X | X | X | X | X | X | X | X | X | | X | X | X | X |
| 6 c′′ | X | X | X | X | X | X | X | X | X | | X | X | X | X |
| 7 c′ | X | X | X | X | | X | X | X | X | X | X | X | X | X |
| 7 c′′ | X | X | X | X | | X | X | X | X | X | X | X | X | X |
| 8 c′ | X | X | X | X | X | X | X | X | X | X | X | X | X | |
| 8 c′′ | X | X | X | X | X | X | X | X | X | X | X | X | X | |
| 9 c′ | X | X | X | X | X | X | X | X | | X | X | X | X | X |
| 9 c′′ | X | X | X | X | X | X | X | X | | X | X | X | X | X |
| 10 c′ | X | X | X | | X | X | X | X | X | X | X | X | X | X |
| 10 c′′ | X | X | X | | X | X | X | X | X | X | X | X | X | X |
| 11 c′ | X | X | X | X | X | X | X | X | X | X | X | X | | X |
| 11 c′′ | X | X | X | X | X | X | X | X | X | X | X | X | | X |
| 12 c′ | X | X | X | X | X | X | X | | X | X | X | X | X | X |
| 12 c′′ | X | X | X | X | X | X | X | | X | X | X | X | X | X |
| 13 c′ | X | X | | X | X | X | X | X | X | X | X | X | X | X |
| 13 c′′ | X | X | | X | X | X | X | X | X | X | X | X | X | X |
| 14 c′ | X | X | X | X | X | X | X | X | X | X | X | | X | X |
| 14 c′′ | X | X | X | X | X | X | X | X | X | X | X | | X | X |

PAPERMAKING FABRIC WITH MUTUALLY CONTACTING PAIRED WEFT THREADS

FIELD OF THE INVENTION

My present invention relates to an industrial fabric for use in paper-making machines and composed of weft and war? threads in a weave in which at least some of the threads of one or both of the weft or warp are grouped so as to lie adjacent one another and be bound in the weave identically.

BACKGROUND OF THE INVENTION

Industrial fabrics for use in paper-making machines serve to carry the pulp through the pressing system and to facilitate the expression of water from the fibrous mass leaving the paper layer on the fabric web formed by the industrial fabric. As a consequence, the latter acts as a screen through which and on which the pulp is converted to the paper web.

In industrial fabrics provided for this purpose heretofore, see Austrian Patent 393,521, for example, the fabric for the paper-making machine can comprise a weft and warp forming a weave in which at least some of the weft and/or warp threads can be grouped together but are not bound identically in the weave i.e. do not follow identical binding patterns for the entire group of mutually adjacent threads.

OBJECTS OF THE INVENTION

While the aforementioned paper-making fabric or screen has been found to be highly effective, it is an object of the invention to further improve upon that fabric so as to enable a more uniform and efficient separation of water from the pulp, dewatering of the mass and formation of a more uniform web of paper.

It is another object of the invention to improve the efficiency of water separation from the pulp.

SUMMARY OF THE INVENTION

Theoretical considerations and practical tests have now shown that a substantial improvement over the paper-making fabric of Austrian Patent 393,521 can be obtained when the grouped weft and/or warp threads according to the invention, within each repeat consist at least in part of weft threads and/or warp threads which lie against one another and are woven into the weave with an identical binding pattern. An identical binding pattern means that the two or more mutually parallel and mutually contacting or adjacent threads of each group, are interwoven in the fabric with the identical weave pattern (in the case of a weft, with the identical crossings of the warp and in the case of a warp group with identical crossings by the weft).

More particularly, an industrial fabric for use in a paper-making machine can comprise:

- a warp comprised of E plurality of warp type threads running longitudinally of the fabric; and
- a weft comprised of a plurality of waft type threads running transversely of the war type threads and woven into the warp to form a weave with a pattern repeat within each pattern repeat at least a part of one of the thread types consists of mutually parallel threads lying one adjacent another and bound together therewith identically in the weave.

The fabric cart be a multilayer fabric with a plurality of layers of weft threads which are interwoven with the warp and at least one weft layer is then provided with mutually parallel groups of weft threads which lie adjacent and against one another and are provided with the identical binding in the weave.

Alternatively, in a multilayer fabric according to the invention with multiple layers of warp threads, which are interwoven with the weft threads, and at least a part of the warp threads are parallel to one another in groups, lie against one another and have the same binding in the weave.

BRIEF DESCRIPTION OF THE DRAWING

The above and other objects, features, and advantages will become more readily apparent from the following description, reference being made to the accompanying drawing in which FIG. 1 is a longitudinal section of a conventional industrial fabric for use in a paper-making machine;

FIG. 2 is a similar section representing a single layer fabric corresponding to the fabric of FIG. I but embodying the invention in which each waft thread is replaced by two mutually parallel weft threads with identical weave patterns in each repeat;

FIG. 3 is a diagram in the form of a longitudinal section rep resenting a conventional double-layer fabric;

FIG. 4 is a section similar to FIG. 3 but showing a fabric in accordance with the invention wherein each of the weft threads of the upper layer of the FIG. 3 embodiment is replaced by two mutually parallel weft threads with the identical weave pattern;

FIG. 5 is a view similar to FIG. 4 of an embodiment in which the weft threads of the lower layer of the prior art construction in accordance with FIG. 3 is replaced by a pair of mutually parallel weft threads;

FIG. 6 is a longitudinal section through a conventional three-layer fabric for use in a paper-making machine;

FIG. 6A is a diagram of the weave or binding pattern of the upper layer of the fabric of FIG. 6;

FIG. 7A is a binding pattern for the upper layer of the embodiment shown in FIG. 7;

FIG. 8A is a binding pattern of this intermediate layer;

FIG. 9A is the binding pattern of this bottom layer.

SPECIFIC DESCRIPTION

FIG. 1 shows a section of an industrial fabric for use in a paper-making machine and through which water can be expressed from a pulp, in highly diagrammatic form. This fabric is a single layer fabric in which the weft threads 1, 2, 3, 4 and 5 are interwoven with warp threads K. As can be seen by a comparison of FIG. 2 with FIG. 1, in the single layer fabric according to the invention, the weft threads 1–5 of the weave according to FIG. 1 are replaced by mutually parallel adjoining pairs of weft threads 1', 1"; 2', 2"; 3', 3"; etc, each pair having the same binding pattern within the fabric.

Similarly, in a two-layer fabric according to the prior art (FZG. 3), the weft threads 1*a*–7*a* form an upper layer and the weft threads 1*b*–7*b* form a second, lower layer The two layers are connected together by the warp threads K In the corresponding system according to the invention, however, as shown in FIG. 4, the waft threads of the upper layer are paired at 1*a*', 1*a*"; 2*a*', 2*a*"; etc. and each of these pairs of mutually parallel adjoining threads are woven into a weave with the same binding pattern.

FIG. 5 shows a modification wherein the lower layer has its weft threads 1*b*', 1*b*"; 2*b*', 2*b*"; . . . paired and woven into the weft K with the same binding pattern per pair. It is also possible to provide both the upper layer and the lower layer with respective groups of parallel threads and to substitute groups of three parallel threads for the groups of two parallel threads in the embodiments of FIGS. 4 and 5 or in an embodiment utilizing groups of threads in each of the two layers.

FIG. 6 shows a longitudinal section through a conventional three-layer fabric for use in a paper-making machine and this fabric can be seen to consist of an upper layer of equally-spaced threads 1*a*, 2*a* . . . 28*a*, an intermediate layer of equally weft threads 1*b*, 2*b* . . . 14*b*, and weft threads 1*c*, 2*c* . . . 14*c*, forming the lower layer. The warp threads K are represented at K1–K14 in the weave pattern diagram of FIG. 6A which corresponds to the embodiment shown in FIG. 6, warp extending through all of the layers of the weft.

Figure 7:
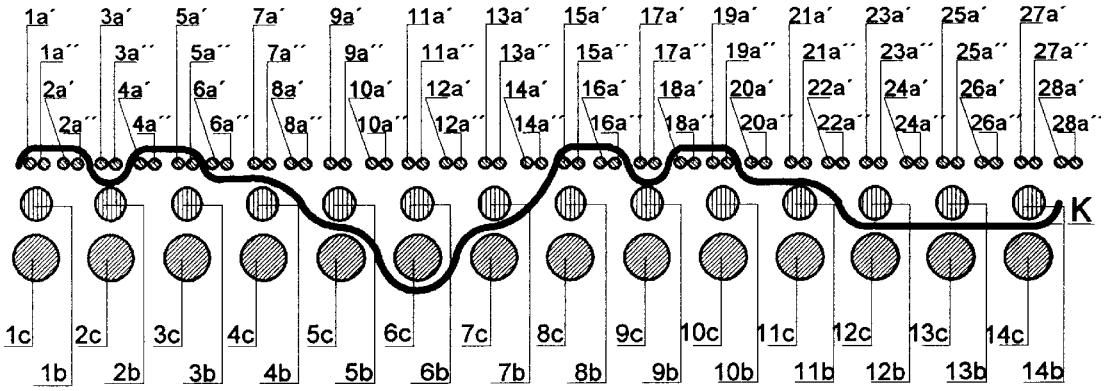
FIG. 7 is a view similar to FIG. 6 but showing a fabric according to the invention in which the weft threads of the upper layer are grouped into two parallel weft threads each with identical binding patterns.
Figure 8:
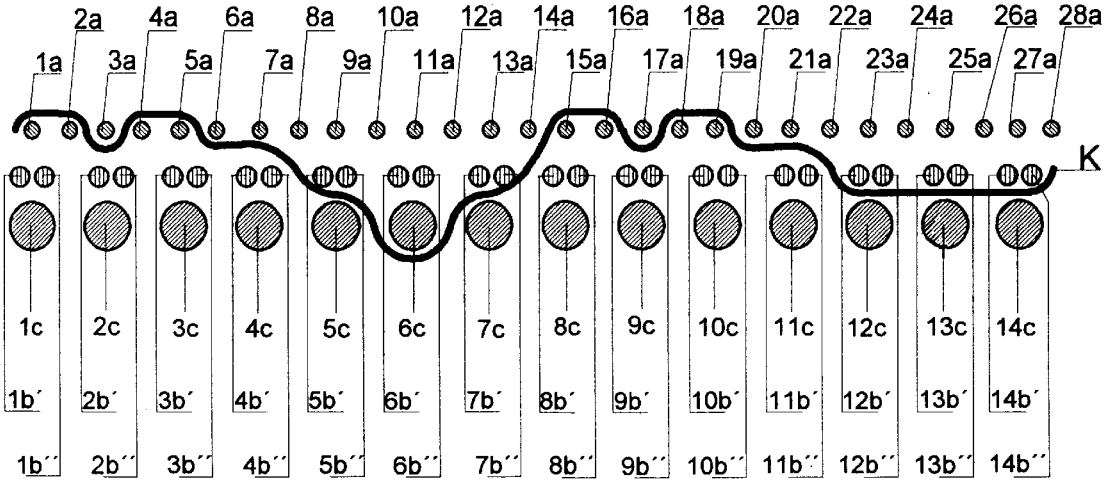
FIG. 8 is a section through a fabric similar to that of FIG. 7 but showing the intermediate layer of the weft grouped in accordance with the invention.
Figure 9:
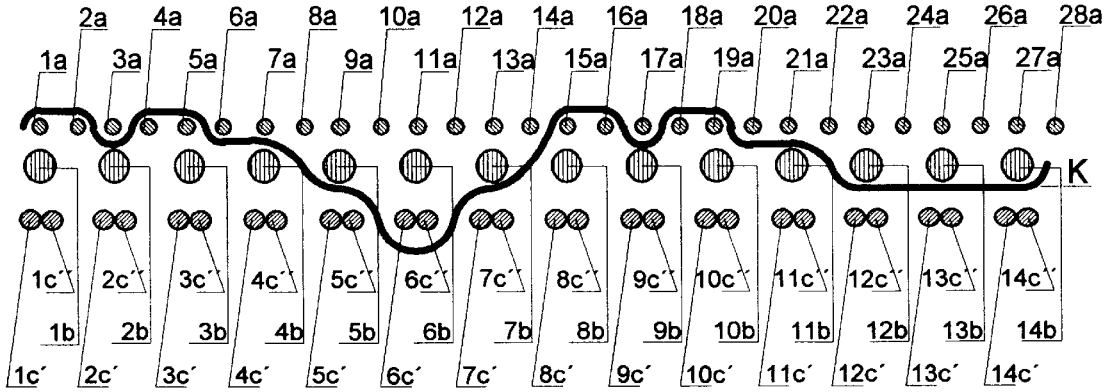
FIG. 9 is a fabric according to the invention in which the lower layer has its weft threads formed in pairs of mutually parallel and mutually contacting threads with the identical binding pattern.

In FIGS. 7, 8 and 9, I have shown three alternatives according to the invention, representing modifications of the fabric of FIG. 6, although, with the identical warp pattern, it is also possible to form a fabric having two or more of the features of the embodiments of FIGS. 7 and 8.

For example, in the embodiment of FIG. 7 and its weave pattern of FIG. 7A, each of the weft threads of the upper layer is doubled an d the paired yarns 1*a*', 1*a*"; 2*a*', 2*a*"; . . . are parallel to one another and are bound identically in the weave. In the embodiment of FIG. 8e however, it is the weft threads 1*b*', 1*b*"; . . . etc. of the intermediate layer which are doubled, lie against on e another, are mutually parallel and are woven with identical patterns in the weave (see also FIG. 8A).

In the embodiment of FIG. 9 (the weave pattern of FIG. 9A), the weft yarns of the lower layer of FIG. 6 are grouped in pairs which are parallel with an identical weave.

In hybrids of the fabrics of FIGS. 7–9, each of the weft layers may be composed of paired threads or groups of three or more mutually parallel adjacent threads with the same binding pattern or any two of the layers may be so paired or grouped.

The preferred fabric of the invention is a three-layer fabric as has been described in connection with FIGS. 7–9. Where the grouped threads are provided on the upper side of the web, the thread count at the upper side is increased and the uniformity of paper web formation is greatly improved by comparison with paper-making fabrics with conventional single-weft threads woven into the warp When the thread grouping is applied to the intermediate layer, improved dewatering is observed. A uniform control of evaporation of moisture is obtained as wall and these results appear to be related to the fact that the water vapor and liquid water channels within the body of the fabric are more uniform.

When the thread grouping occurs at the lower side of the fabric, the frictional characteristics of the fabric are improved and the fabric wear is reduced with a corresponding lengthening of the useful life of the fabric.

Of course, the warp threads can be similarly grouped and each warp thread represented in FIGS. 7A–9A can be doubled as well and interwoven with the deft in the identical pattern as the warp thread adjoining it in the respective pair.

Each thread mentioned above may be a monofilament, and where groups of monofilaments replace individual monofilaments of the conventional fabric in accordance with the invention, the diameters of the monofilaments of the group can be less than the diameters of the monofilaments which the group of threads replaces. The result in general is a reduction in the overall fabric thickness which can lead to a reduced water drag or entrainment and a reduced need for power to displace the fabric. The fabric of the invention, therefore, can result in a reduction of the energy costs in operating the paper-making machine.

I claim:

1. A papermaking machine fabric having a top receiving a layer of pulp containing water to be expressed therefrom for producing a paper web, said fabric consisting of two weft layers including an upper weft layer and a lower weft layer each composed of waft threads, and a warp comprised of warp threads interwoven with said weft threads of both said layers to form a weave with a pattern repeat and extending longitudinally of the fabric, said weft threads of said upper weft layer being provided in pairs of mutually parallel weft threads lying against one another and interwoven together by each of said warp threads with an identical binding in the fabric, said weft threads of said upper layer having a smaller diameter than the weft threads of said lower layer.

2. A papermaking machine fabric having a top receiving a layer of pulp containing water to be expressed therefrom for producing a paper web said fabric consisting of three weft layers each composed of weft threads, and a warp comprised of warp threads interwoven with said weft threads of all three of said layers to form a weave with a pattern repeat and extending longitudinally of the fabric, said weft threads of at least one of said waft layers being provided in pairs of mutually parallel weft threads lying against one another and interwoven together by each of said warp threads with an identical binding in the fabric, said weft threads of said at least one of said layers having a smaller diameter than the weft threads of at least one other of said layers.

* * * * *